US010220648B2

(12) United States Patent
Walk

(10) Patent No.: US 10,220,648 B2
(45) Date of Patent: Mar. 5, 2019

(54) REMOVABLE COVER FOR A BINDER

(71) Applicant: Shea Walk, Frisco, TX (US)

(72) Inventor: Shea Walk, Frisco, TX (US)

( * ) Notice: Subject to any disclaimer, the term of this patent is extended or adjusted under 35 U.S.C. 154(b) by 0 days.

(21) Appl. No.: 15/383,029

(22) Filed: Dec. 19, 2016

(65) Prior Publication Data

US 2017/0282631 A1 Oct. 5, 2017

Related U.S. Application Data

(60) Provisional application No. 62/317,947, filed on Apr. 4, 2016.

(51) Int. Cl.
*B42F 13/00* (2006.01)
*B42F 13/40* (2006.01)

(52) U.S. Cl.
CPC ..... *B42F 13/40* (2013.01); *B42F 13/0026* (2013.01); *B42F 13/0066* (2013.01)

(58) Field of Classification Search
CPC ..... B42D 3/123; B42D 3/045; B42F 13/0006
USPC ..... 281/29, 31; 402/73
See application file for complete search history.

(56) References Cited

U.S. PATENT DOCUMENTS 1,913,634 A * 6/1933 Impey ..... B42D 3/004 281/37
5,013,068 A * 5/1991 Maldonado ..... B42D 3/004 206/424
5,015,011 A * 5/1991 York ..... B42F 13/0006 281/15.1
5,087,078 A * 2/1992 Phillips ..... B42D 3/04 281/29
5,219,437 A * 6/1993 Moor ..... B42D 3/02 281/29
5,577,918 A * 11/1996 Crowell ..... B42D 15/022 150/147
D382,900 S * 8/1997 Wyant ..... D19/27
6,045,160 A * 4/2000 Weeks ..... B42D 3/04 281/29
6,213,670 B1 * 4/2001 Wien ..... B42F 13/0006 190/109
6,224,955 B1 * 5/2001 Gorski ..... B42D 3/004 206/453
6,257,622 B1 * 7/2001 Peker ..... B42D 3/04 281/16
6,513,836 B2 * 2/2003 Li ..... B42D 3/123 281/22
6,764,242 B1 * 7/2004 Karten ..... B42F 13/0053 281/15.1
6,767,152 B1 * 7/2004 Wehmeyer ..... A45C 15/00 150/113
7,201,528 B1 * 4/2007 Swegart ..... B42F 13/0006 211/45
7,281,877 B1 * 10/2007 Lederer ..... A45C 11/24 281/31

(Continued)

*Primary Examiner* — Shin H Kim
(74) *Attorney, Agent, or Firm* — Robert E. Wise

(57) ABSTRACT

Embodiments disclosed herein relate to a binder cover system comprising: a binder comprising a front portion and a rear portion; and a cover removably coupled to the binder and comprising: a front sleeve defining a cavity in which the front portion of the binder is received; and a rear sleeve defining a cavity in which the rear portion of the binder is received; and a utility pocket coupled to at least one of the front sleeve and the rear sleeve.

18 Claims, 5 Drawing Sheets

(56) References Cited

U.S. PATENT DOCUMENTS

| | | | | |
|---|---|---|---|---|
| 2003/0012013 | A1* | 1/2003 | Herrera | F21V 33/0048 362/99 |
| 2004/0218967 | A1* | 11/2004 | Hendee | B42D 3/04 402/73 |
| 2005/0180809 | A1* | 8/2005 | Wu | B42D 3/123 402/70 |
| 2005/0254885 | A1* | 11/2005 | Laufer | B42F 13/0006 402/73 |
| 2005/0269815 | A1* | 12/2005 | Silverman | B42D 3/04 281/29 |
| 2007/0114782 | A1* | 5/2007 | Shapiro | B42D 5/006 281/29 |
| 2013/0214119 | A1* | 8/2013 | Antonioni | B60R 11/00 248/614 |
| 2013/0285360 | A1* | 10/2013 | Humphries | B42D 3/045 281/31 |
| 2014/0241784 | A1* | 8/2014 | Baker | B42F 13/40 402/4 |

* cited by examiner

REMOVABLE COVER FOR A BINDER

CROSS REFERENCE TO RELATED APPLICATIONS

This application is a nonprovisional application of, and claims priority to, U.S. Provisional Patent Application No. 62/317,947 filed on Apr. 4, 2016 and entitled "REMOVABLE COVER FOR A BINDER," the disclosure of which is hereby incorporated by reference in its entirety.

TECHNICAL FIELD

Embodiments described herein are related to a removable cover for a binder.

BACKGROUND

While three-ring binders are often used to efficiently store and organize collections of loose leaf papers, their utility rarely extends beyond simple paper storage and organization. Thus, additional utility of three-rind binders is desired.

BRIEF SUMMARY

Embodiments described herein may relate to a removable cover to be installed on a three-ring binder. The removable cover may not only protect outer surfaces of the three-ring binder from potential surface damage, but also provide additional utility and improved aesthetics to the three-ring binder. For example, the removable cover may include a sealable pocket for storing pens, pencils, and/or other utensils often used in conjunction with paper products. The removable cover may also include security features for controlling access to contents stored in the three-ring binder and/or the sealable pocket. Additional features incorporated into the removable cover may include lights, speakers, and/or various connectivity ports for integrating with computing devices such as laptops, tablets, and smart phones. The removable cover may further be customizable in size, shape, color, material, and/or aesthetic design based on binder dimensions and/or binder type.

In some embodiments, a system is provided, where the system comprises: a binder comprising a front portion and a rear portion; and a cover removably coupled to the binder and comprising: a front sleeve defining a cavity in which the front portion of the binder is received; and a rear sleeve defining a cavity in which the rear portion of the binder is received; and a utility pocket coupled to at least one of the front sleeve and the rear sleeve.

In some embodiments, the utility pocket is detachedly coupled to at least one of the front sleeve and the rear sleeve via a closure mechanism, wherein the closure mechanism comprises at least one of a zipper, a button, a fastener, a pin, a brad, a latch, and a Velcro strip.

In some embodiments, the utility pocket comprises a security mechanism for controlling access to contents of the utility pocket, wherein the security mechanism comprises at least one of a fingerprint scanner, a retina scanner, a pinpad, and a lock.

In some embodiments, at least one of the front portion and the rear portion comprises a binder pocket, and wherein the utility pocket is substantially orthogonal to the binder pocket.

In some embodiments, the cover comprises at least one reinforcement tab manufactured from a rigid material that is coupled to at least one of the front sleeve and the second sleeve, and wherein the front sleeve and the second sleeve is manufactured from a stretchable material.

In some embodiments, the cover comprises at least one of a light, a speaker, a connectivity port, and a global positioning system (GPS) device.

In some embodiments, the cover comprises at least one of a texture and a graphic.

In some embodiments, a cover is provided, where the cover is removably coupled to a binder comprising a front portion and a rear portion and comprises: a front sleeve defining a cavity in which the front portion of the binder is received; a rear sleeve defining a cavity in which the rear portion of the binder is received; and a utility pocket coupled to at least one of the front sleeve and the rear sleeve.

In some embodiments, the utility pocket is detachedly coupled to at least one of the front sleeve and the rear sleeve via a closure mechanism, wherein the closure mechanism comprises at least one of a zipper, a button, a fastener, a pin, a brad, a latch, and a Velcro strip.

In some embodiments, the utility pocket comprises a security mechanism for controlling access to contents of the utility pocket, wherein the security mechanism comprises at least one of a fingerprint scanner, a retina scanner, a pinpad, and a lock.

In some embodiments, at least one of the front portion and the rear portion comprises a binder pocket, and wherein the utility pocket is substantially orthogonal to the binder pocket.

In some embodiments, the cover comprises at least one reinforcement tab manufactured from a rigid material that is coupled to at least one of the front sleeve and the second sleeve, and wherein the front sleeve and the second sleeve is manufactured from a stretchable material.

In some embodiments, the cover comprises at least one of a light, a speaker, a connectivity port, and a global positioning system (GPS) device.

In some embodiments, the cover comprises at least one of a texture and a graphic.

In some embodiments, a method is provided, where the method comprises: receiving, by a computing device processor and from a camera, a digital image of a binder; processing, by the computing device processor, the digital image to identify at least one dimension of the binder; generating, by the computing device processor, a three-dimensional model of the binder using the at least one dimension; generating, by the computing device processor, a three-dimensional model of a removable cover for the binder based on the three-dimensional model of the binder; and transmitting, by the computing device processor and to a printer, instructions to print the removable cover based on the three-dimensional model of the removable cover.

In some embodiments, the method further comprises: determining, by the computing device processor, an optimal material type for the removable cover based on the identified at least one dimension of the binder.

In some embodiments, the printer is a three-dimensional (3D) printer, and wherein the instructions instruct the printer to 3D print the removable cover using the determined optimal material type.

In some embodiments, the printer is a screen printer, and wherein the instructions to print the removable cover comprise instructions to screen print a graphic on a portion of the optimal material type.

In some embodiments, the method further comprises: receiving, by the computing device processor and from a user device, a user selection of the graphic.

In some embodiments, the binder comprises at least one of a three-ring binder, a notebook, a book, and a notepad.

BRIEF DESCRIPTION OF THE FIGURES

Reference is now made to the following detailed description, taken in conjunction with the accompanying drawings. It is emphasized that various features may not be drawn to scale and the dimensions of various features may be arbitrarily increased or reduced for clarity of discussion. Further, some components may be omitted in certain figures for clarity of discussion.

In the various figures, the same reference numbers are provided for the same system elements, whereas in other instances similar elements shown in different figures may have different reference numbers. The figures and associated description provide a plurality of different embodiments and similar elements among the figures will illustrate to one of ordinary skill in the art the possible functionality and connection of those elements in the multiple and collective embodiments disclosed herein.

DETAILED DESCRIPTION OF THE INVENTION

Figure 1:
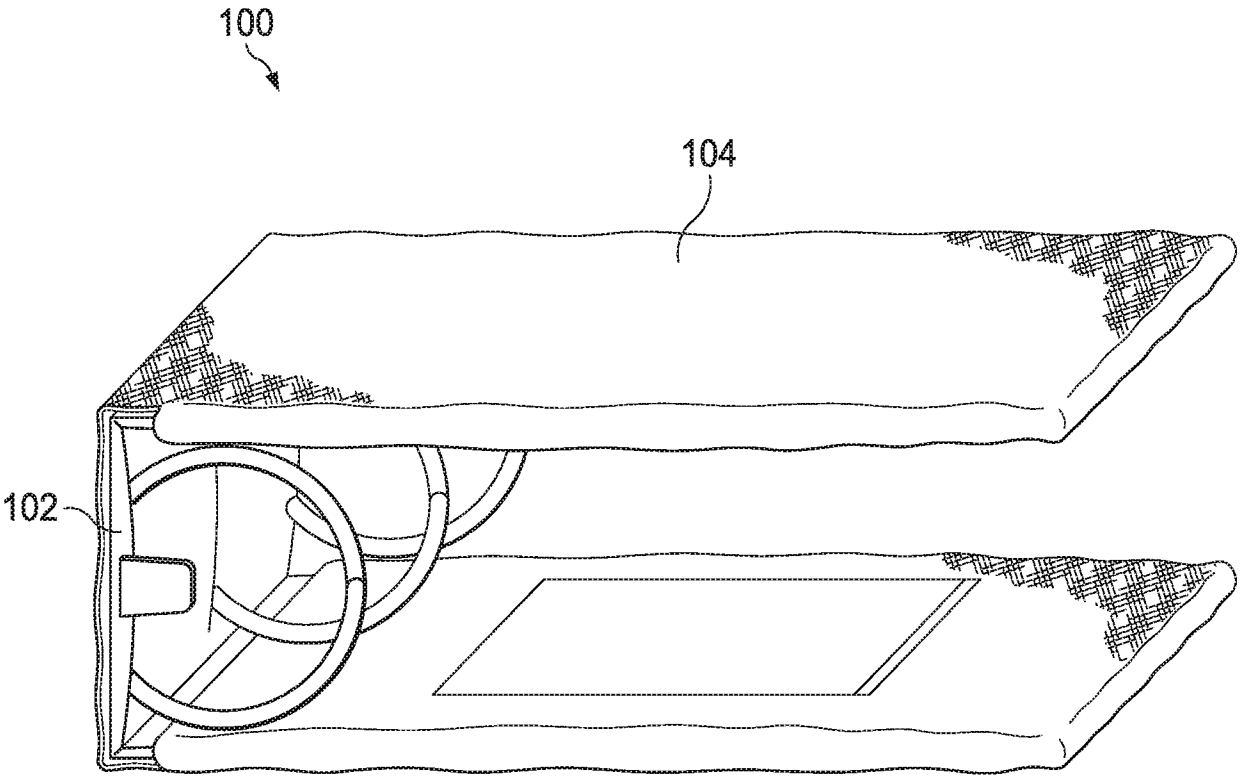
FIG. 1 shows an exemplary perspective view of a binder cover system, in accordance with some embodiments of the disclosure.

Referring now to the figures, FIG. 1 shows a perspective view of an exemplary binder cover system 100 as described herein. As shown, the binder cover system 100 may include a binder 102 (e.g., a three-ring binder) and a removable binder cover 104 configured and/or adapted to be installed on the binder 102 as described herein.

Figure 2:
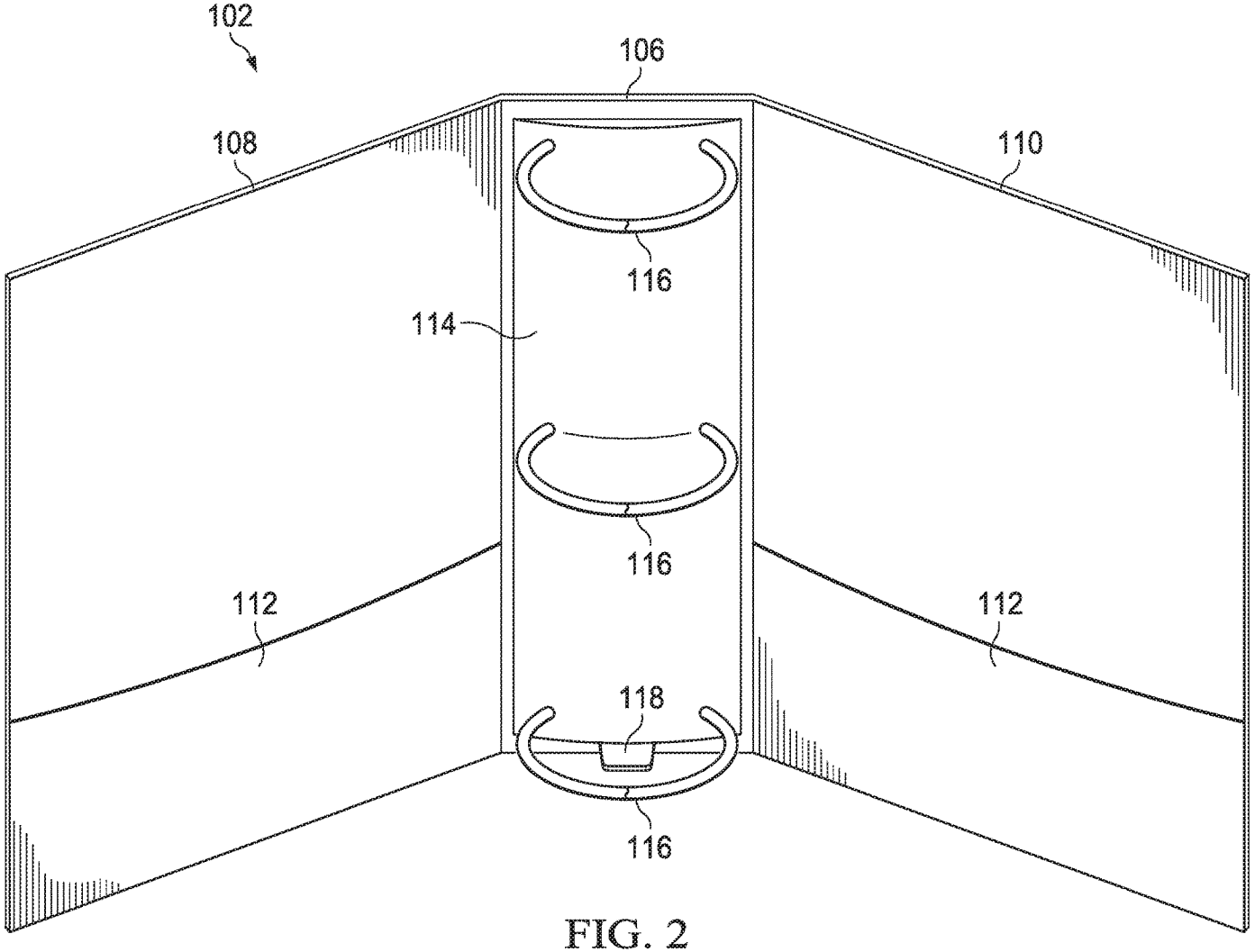
FIG. 2 shows an exemplary perspective view of a binder, in accordance with some embodiments of the disclosure.

FIG. 2 illustrates an exemplary perspective view of the binder 102. As shown, the binder 102 may include a three-ring binder, a folder, a notebook, a notepad, a stack and/or collection of papers, a book, and/or another type of paper holding device. The binder 102 may be manufactured from a variety of materials such as plastic, vinyl, metal, paper, cardboard, and/or a combination of the aforementioned materials. In some embodiments, the binder 102 may be substantially rigid in construction. Alternatively, the binder 102 may be pliable, bendable, and/or flexible.

In some embodiments, the binder 102 may include a spine portion 106, a front portion 108 coupled to the spine portion 106 on a front end of the spine portion 106, and a rear portion 110 coupled to the spine portion 106 on a rear end of the spine portion 106. Each of the spine portion 106, the front portion 108, and the rear portion 110 of the binder 102 may define an exterior surface and an interior surface. In some embodiments, each of the exterior surface and/or the interior surface of each of the spine portion 106, the front portion 108, and the rear portion 110 of the binder 102 may include a binder pocket 112 for storing and/or displaying papers, business cards, and/or the like.

In some embodiments, a ring system 114 may be operatively coupled to the interior surface of the spine portion 106 of the binder 102. The ring system 114 may include one or more rings 116 for securing papers. The rings of the ring system 114 may be inserted through punched holes in each piece of paper that is to be stored in the binder 102. In some embodiments, the rings 116 may include a variety of other fasteners such as brads, staples, paperclips, adhesives, binding agents, and/or the like. The ring system 114 may also include a locking mechanism 118 that enables a user to open and/or close the rings 116 of the ring system 114 so that papers may be added to and/or removed from the rings 116 as desired for storage and/or organization.

Figure 3:
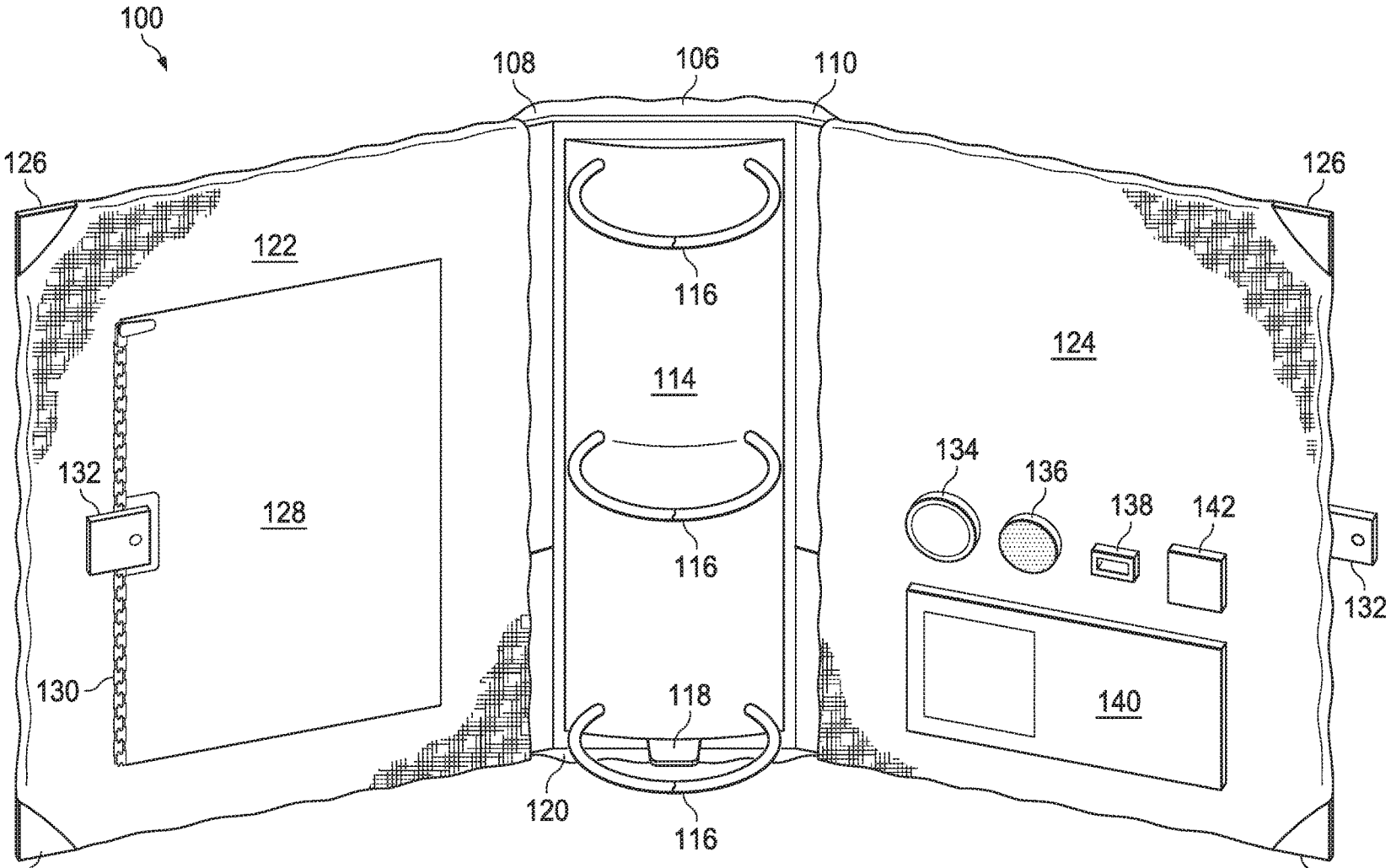
FIG. 3 shows an exemplary perspective view of an installed binder cover, in accordance with some embodiments of the disclosure.

FIG. 3 illustrates an exemplary perspective view of the binder cover system 100 where the cover 104 installed on (e.g., coupled to) the binder 102. Preferably, the cover 104 may be removably coupled to the exterior surfaces and/or interior surfaces of the spine portion 106, the front portion 108, and/or the rear portion 110 of the binder 102. For example, the cover 104 may couple to the binder 102 using frictional forces and/or properties of its materials of manufacture as described herein, one or more fasteners such as hook and loop fasteners (e.g., VELCRO), one or more magnets, tape, clips, rings, hooks, clamps, and/or the like. Alternatively, the cover 104 may be permanently coupled to the exterior and/or interior surfaces of the spine portion 106, the front portion 108, and/or the rear portion 110 of the binder 102 using an adhesive material (e.g., glue), staples, and/or the like.

The cover 104 may be manufactured from a flexible material such as fabric, cloth, cotton, polyester, plastic, vinyl, elastic, elastic cotton, acrylic, nylon, rayon, acetate, spandex, latex, Kevlar, and/or the like. In some embodiments, the material(s) of the cover 104 may be stretchable so that the cover 104 can be stretched and thus fitted over surfaces of the binder 102. In this manner, the cover 104 may be enabled to fit (e.g., be installed on and/or cover) a variety of differently sized binders. Alternatively, the cover 104 may be manufactured from a rigid material such as a hard plastic, a metal, an alloy, and/or the like. In some embodiments, the cover 104 may include anti-stick material and/or portions of anti-stick material that prevent the cover 104 (and thus the binder 102 when installed within the cover 104) from undesirably sliding along a smooth surface while providing a user with enhanced grip of the binder 102.

As seen in FIG. 3, the cover 104 may include a spine sleeve 120, a front sleeve 122 operably coupled to the spine sleeve 120, and a rear sleeve 124 operably coupled to the spine sleeve 120. In some embodiments, the spine sleeve 120, the front sleeve 122, and the rear sleeve 124 of the cover 104 may be manufactured independent of each other and then coupled (e.g., sewn) together. Alternatively, the spine sleeve 120, the front sleeve 122, and the rear sleeve 124 of the cover 104 may be manufactured from one continuous piece of material.

In some embodiments, the front sleeve 122 may include two layers of material (e.g., fabric, and/or the like) operably coupled (e.g., sewn) together so as to create a front pocket between the two layers of material of the front sleeve 122 (e.g., within the interior of the front sleeve 122). As such, the front pocket of the front sleeve 122 of the cover 104 may be enabled to receive the front portion 108 of the binder 102 wherein the front sleeve 122 substantially covers (e.g., surrounds) at least a portion of the front portion 108 of the binder 102. In this manner, the front portion 108 of the binder 102 may be inserted into, removed from, and/or secured within the front sleeve 122 of the cover 104. An elastic property of the material of the cover 104 may enable the front sleeve 122 of the cover 104 to retract and therefore apply a frictional force upon the front portion 108 of the binder 102 when it is inserted into the front sleeve 122 of the cover 104, thus securing the front portion 108 of the binder 102 within the front pocket of the front sleeve 122 of the cover 104.

Similarly, the rear sleeve 124 may include two layers of material (e.g., fabric, and/or the like) operably coupled (e.g., sewn) together so as to create a rear pocket between the two layers of material of the rear sleeve 124 (e.g., within the interior of the front sleeve 124). As such, the rear pocket of the rear sleeve 124 of the cover 104 may be enabled to receive the rear portion 110 of the binder 102 wherein the rear sleeve 124 substantially covers (e.g., surrounds) at least a portion of the rear portion 110 of the binder 102. In this manner, the rear portion 110 of the binder 102 may be inserted into, removed from, and/or secured within the rear sleeve 124 of the cover 104. An elastic property of the material of the cover 104 may enable the rear sleeve 124 of the cover 104 to retract and therefore apply a frictional force upon the rear portion 110 of the binder 102 when it is inserted into the rear sleeve 124 of the cover 104, thus securing the rear portion 108 of the binder 102 within the rear pocket of the rear sleeve 124 of the cover 104.

In some embodiments, the spine sleeve 120 of the cover 104 may be enabled to receive the spine portion 108 of the binder 102 so as to cover (e.g., surround) at least a portion of the spine portion 108 of the binder 102. The spine sleeve 120 of the cover 104 may include one layer of material so as to substantially cover the exterior surface of the spine portion 108 of the binder 102, or may include two layers of material so as to substantially cover both exterior and interior surfaces of the spine portion of the binder 102.

Each layer of material of the cover 104 included in the spine sleeve 120, the front sleeve 122, and/or the rear sleeve 124 of the cover 104 may be operatively coupled to other layers of materials and/or portions of the cover 104 as described above using one or more sewn threaded seams. In some embodiments, each seam may define a different stitching pattern and/or sewing pattern. For example, the seams coupling the spine sleeve 120 of the cover 104 to the front sleeve 122 and/or the seams coupling the spine sleeve 120 of the cover 104 to the rear sleeve 124 of the cover 104 may have reinforced seams (e.g., double seams, thicker threading, double stitching, and/or the like), whereas the seams coupling the two layers of material of each of the front sleeve 122 and the rear sleeve 124 may have unreinforced seams (e.g., single seams, thinner threading, single stitching, and/or the like). In this manner, the cover 104 may be reinforced in areas known of high wear and/or motion (e.g., repeated opening and/or closing of the binder 102 may increase wear near the spine sleeve 120 of the cover 104).

Additionally, as shown in FIG. 3, each corner of the cover 104 (e.g., each corner of the front sleeve 122 and/or the rear sleeve 124) may include a reinforcement tab 126. The reinforcement tabs 126 may be manufactured from a rigid material such as a hard plastic, vinyl, metal, wood, and/or the like so as to minimize the wear and tear on the seams of the each corner of the front sleeve 122 and/or the rear sleeve 124 and thus maximize durability. In some embodiments, the reinforcement tabs 126 may be operatively coupled to an inside surface of at least one of the front sleeve 122 and the rear sleeve 124. Alternatively, the reinforcement tabs 126 may be operatively coupled to an outside surface of at least one of the front sleeve 122 and the rear sleeve 124.

In some embodiments, the front sleeve 122 and/or the rear sleeve 124 may include a utility pocket 128 for storing various accessories. The utility pocket 128 may be positioned on an interior surface the front sleeve 122 of the cover 104 and/or the rear sleeve 124 of the cover 104 (e.g., a surface facing upward when the binder 102 and cover 104 are fully opened when resting on a flat horizontal surface). In some embodiments, the utility pocket 128 may extend within the interior of the front sleeve 122 of the cover 104 and/or the rear sleeve 124 of the cover 104 (e.g., within the front pocket and/or the rear pocket, respectively). In some embodiments, the utility pocket 128 may be aligned with the binder pocket 112 (e.g., has the same height, depth, width, and/or other dimensions) of the front portion 108 and/or the rear portion 110. For example, the utility pocket 128 may include a stabilization element (not pictured) that is configured to be inserted into a binder pocket 112 of the front portion 108 and/or the rear portion 110 of the binder 102 to increase stability and ensure a secure fit of the cover 104 when installed on the binder 102. The utility pocket 128, the closure mechanism 130, and/or the security mechanism 132 may be positioned substantially vertically and/or substantially orthogonal to the binder pocket 112.

The utility pocket 128 may be manufactured as a separate piece of the same material as the front sleeve 122 of the cover 104 and/or the rear sleeve 124 of the cover 104 and/or a different material such as a more durable or rigid material. In some embodiments, the utility pocket 128 may include a plastic liner. The utility pocket 128 may be sized appropriately so that a plurality of pens, pencils, markers, post-it notes, small papers, paper clips, erasers, electronic devices, smart phones, tablets, and/or other items may be stored for convenience.

The utility pocket 128 may include an opening with a closure mechanism 130 for closing the opening of the utility pocket 128. For example, the closure mechanism 130 may include a zipper, a pin, a snap, a button, a latch, a string, hook and loop fasteners such as Velcro, magnets, and/or the like. In some embodiments, the closure mechanism 130 may be automated and/or its operation may be controlled by a computing processor as described herein.

The utility pocket 128 may further include a security mechanism 132 for controlling access to the utility pocket 128 and its contents. For example, the security mechanism 132 may include a biometric scanner (e.g., retina scanner, fingerprint scanner, and/or the like), a lock, a pinpad, a latch, a sensor, and/or the like. As such, a user may be required to input a password or provide a particular form of user input to the security mechanism 132, which may then process the user input and determine whether the user is granted access to the contents of the utility pocket 128. In some embodiments, determining that the user is authorized to access the contents of the utility pocket 128 based on received user input and by the security mechanism may include automatically opening the closure mechanism 130 so that the user may access the contents of the utility pocket 128. Additionally, the cover 104 may include a similar security mechanism 132 for controlling access to the binder 102 and its contents.

In some embodiments, the cover 104 may also include a light 134 and a speaker 136. The light 134 may provide a user with reading light when using the contents of the binder 102. The light may further serve as a beacon and/or a strobe to assist a user with locating the binder 102 in a dark environment. The speaker 136 may emit audio for reading assistance and/or listening pleasure as well as for audibly locating the binder 102 in a cluttered and/or dark environment. The speaker 136 may be enabled to connect to a user's computing device (e.g., smart phone) via Bluetooth, Wi-Fi, and/or other networks for controlling play of music.

The cover may further include a connectivity port 138 for connecting one or more electronic devices (e.g., computer, smart phones, laptops, tablets, wearable devices, and/or the like) to elements of the cover, such as a the light 134, the speaker 136, and/or a computer 140 included in the cover. In some embodiments, the connectivity port 138 may include a USB port, a power outlet, a FireWire port, a WiFi hotspot, a Bluetooth engine, and/or any other network connection port.

The computer 140 as described herein may control various processes associated with the closure mechanism 130 of the utility pocket 128, the security mechanism 132 of the utility pocket 128 and/or of the cover 104, the light 134, the speaker 136, the connectivity port 138, and/or a global positioning system (GPS) device 142 described below. The computer 140 may include a display, a processing device, non-transitory computer-readable storage media, input/output (I/O) devices, a communication device, a battery, and/or the like. In some embodiments, a user may be enabled by the connectivity port 138 and/or the computer 140 to charge her/his computing device (e.g., smart phone) by drawing power from the battery of the computer 140 of the cover 104.

The cover 104 may further include a global positioning system (GPS) device 142 for assisting a user with locating the binder 102. The GPS device 142 may integrate with a user's smart phone and/or other computing device so that the user may identify and/or track a location of the binder 102 from anywhere in the world at any time.

In some embodiments, the utility pocket 128, the closure mechanism 130, the security mechanism 132, the light 134, the speaker 136, the connectivity port 138, the computer 140, and/or the GPS device 142 may be detachably coupled to the cover 104. For example, each of the utility pocket 128, the closure mechanism 130, the security mechanism 132, the light 134, the speaker 136, the connectivity port 138, the computer 140, and/or the GPS device 142 may include means for coupling to the cover 104, where the means includes Velcro, zippers, clips, buttons, pins, and/or other fasteners. In some embodiments, the closure mechanism 130, the security mechanism 132, the light 134, the speaker 136, the connectivity port 138, the computer 140, and/or the GPS device 142 may be detachably coupled to the utility pocket 128 in a similar fashion.

Figure 4:
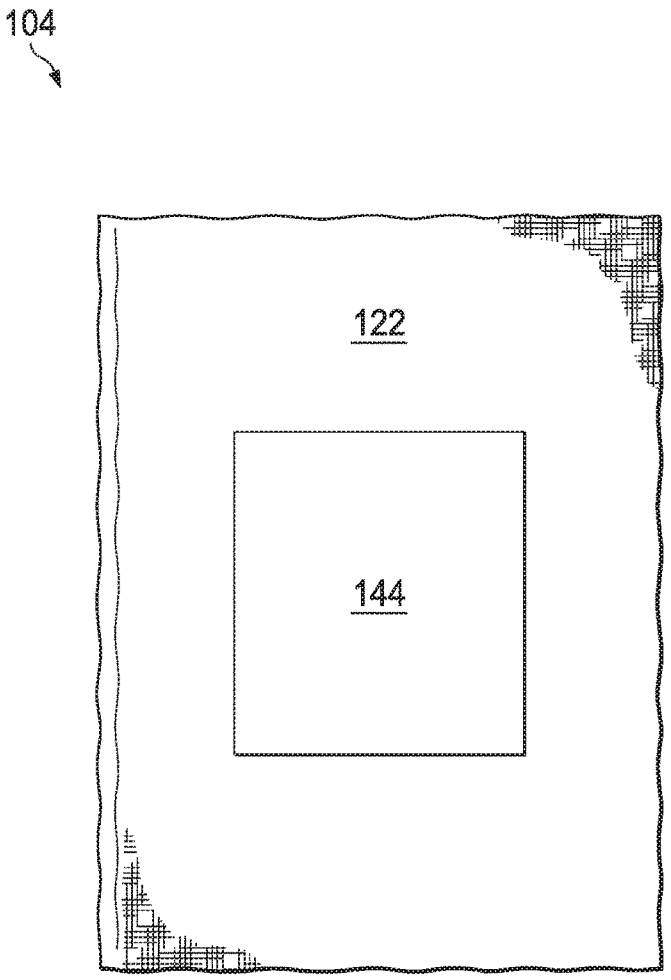
FIG. 4 shows an exemplary front view of a binder cover, in accordance with some embodiments of the disclosure.

FIG. 4 illustrates a front view of the binder cover system 100 described herein. As shown, the cover 104 may include a graphic 144 to provide desirable aesthetic qualities to the cover 104. In some embodiments, the graphic 144 may be inserted into a slot, pouch, and/or pocket included on the front sleeve 122 of the cover 104. In this manner, the graphic 144 may be interchanged as desired. Alternatively, the graphic 144 may be screen printed onto the cover 104.

Further, the cover 104 may include a texture. For example, the cover 104 may look and feel smooth like leather, fuzzy like hair (e.g., a mass or coating of light, fibrous, fluffy matter), and/or the like. Artistically, the cover 104 may be in any color combination, texture combination, and/or material combination to achieve a desired and/or enhanced look and feel of the cover and therefore the binder.

The cover 104 may be manufactured by a three-dimensional (3D) printing process. For example, a scanner and/or camera may scan the binder 102 to capture digital images of the binder 102. A computing processor may then analyze the digital images of the binder 102 to identify its dimensions. Next, the computing processor may generate a 3D digital model of the binder using the identified dimensions, and then generate a 3D digital model of the cover 104 so that the cover 104 is appropriately dimensioned to fit the exact dimensions of the binder 102. The computing processor may instruct a 3D printer to print the cover 104 as modeled, thus ensuring the cover 104 is a perfect fit when installed on the binder 102. The computing processor may also instruct a screen printer to print a particular graphic on the cover 104 as desired.

Figure 5:
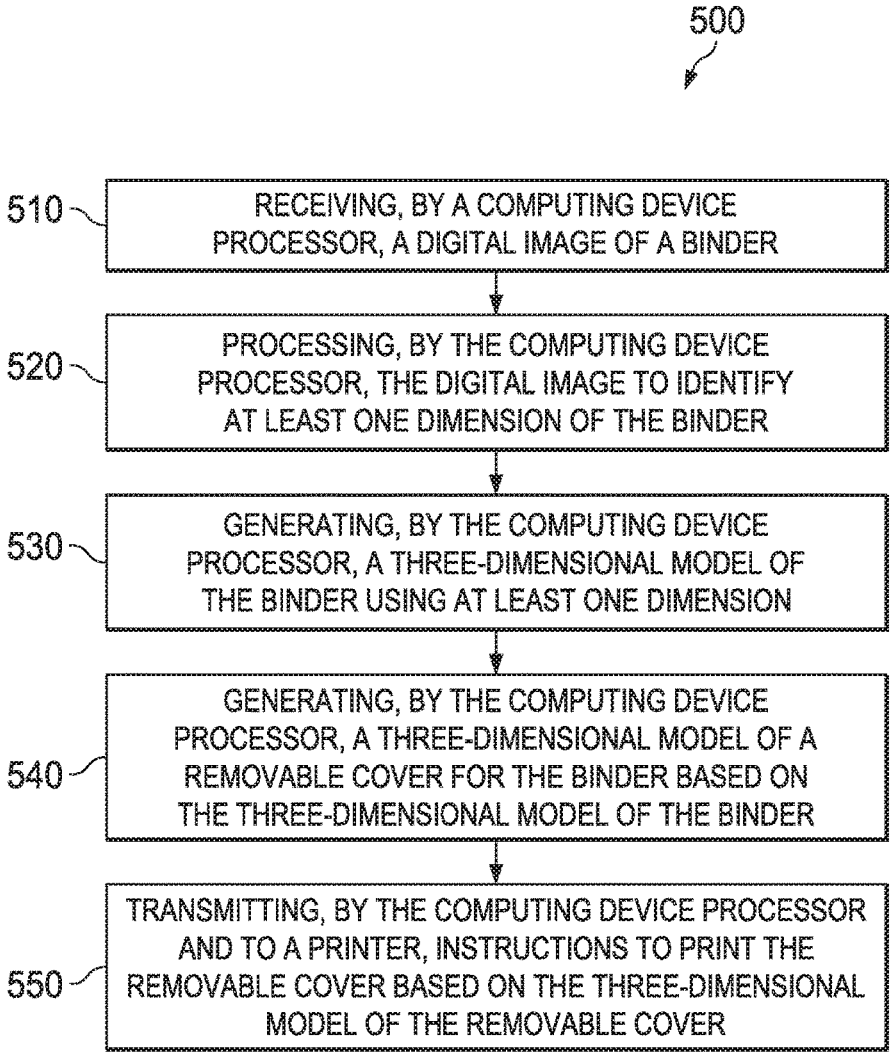
FIG. 5 shows an exemplary process for manufacturing a binder cover, in accordance with some embodiments of the disclosure.

FIG. 5 illustrates an exemplary process 500 for manufacturing the cover 104 described herein. At block 510, the process 500 includes receiving, by a computing device processor, a digital image of a binder. At block 520, the process 500 includes processing, by the computing device processor, the digital image to identify at least one dimension of the binder. At block 530, the process 500 includes generating, by the computing device processor, a three-dimensional model of the binder using the at least one dimension. At block 540, the process 500 includes generating, by the computing device processor, a three-dimensional model of a removable cover for the binder based on the three-dimensional model of the binder. At block 550, the process 500 includes transmitting, by the computing device processor and to a printer, instructions to print the removable cover based on the three-dimensional model of the removable cover.

In some embodiments, the computing device processor as described with reference to FIG. 5 may also select and/or identify an optimal material type based on the at least one dimension and/or the digital image of the binder. The removable cover may then be printed using the selected material type. The printer may be a screen printer and/or a three-dimensional printer. Printing the removable cover may include screen printing a graphic on a piece of the selected material type, wherein the piece of the selected material type is sized based on the at least one dimension. The graphic may be an image received from a user device.

While various implementations in accordance with the disclosed principles have been described above, it should be understood that they have been presented by way of example only, and are not limiting. Thus, the breadth and scope of the implementations should not be limited by any of the above-described exemplary implementations, but should be defined only in accordance with the claims and their equivalents issuing from this disclosure. Furthermore, the above advantages and features are provided in described implementations, but shall not limit the application of such issued claims to processes and structures accomplishing any or all of the above advantages.

Various terms used herein have special meanings within the present technical field. Whether a particular term should be construed as such a "term of art," depends on the context in which that term is used. "Connected to," "in communication with," "communicably linked to," "in communicable range of" or other similar terms should generally be construed broadly to include situations both where communications and connections are direct between referenced elements or through one or more intermediaries between the referenced elements, including through the Internet or some other communicating network. "Network," "system," "environment," and other similar terms generally refer to networked computing systems that embody one or more aspects of the present disclosure. These and other terms are to be construed in light of the context in which they are used in the present disclosure and as those terms would be understood by one of ordinary skill in the art would understand those terms in the disclosed context. The above definitions are not exclusive of other meanings that might be imparted to those terms based on the disclosed context.

Words of comparison, measurement, and timing such as "at the time," "equivalent," "during," "complete," and the like should be understood to mean "substantially at the time," "substantially equivalent," "substantially during," "substantially complete," etc., where "substantially" means that such comparisons, measurements, and timings are practicable to accomplish the implicitly or expressly stated desired result.

Additionally, the section headings herein are provided for consistency with the suggestions under 37 C.F.R. 1.77 or otherwise to provide organizational cues. These headings shall not limit or characterize the implementations set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any implementations in this disclosure. Neither is the "Summary" to be considered as a characterization of the implementations set forth in issued claims. Furthermore, any reference in this disclosure to "implementation" in the singular should not be used to argue that there is only a single point of novelty in this disclosure. Multiple implementations may be set forth according to the limitations of the multiple claims issuing from this disclosure, and such claims accordingly define the implementations, and their equivalents, that are protected thereby. In all instances, the scope of such claims shall be considered on their own merits in light of this disclosure, but should not be constrained by the headings herein.

Lastly, although similar reference numbers may be used to refer to similar elements for convenience, it can be appreciated that each of the various example implementations may be considered distinct variations.

What is claimed is:

1. A system comprising: a binder comprising a front portion and a rear portion; and a cover removably coupled to the binder and comprising: a front sleeve defining a cavity in which the front portion of the binder is received; and a rear sleeve defining a cavity in which the rear portion of the binder is received; and a utility pocket coupled to at least one of the front sleeve and the rear sleeve, wherein the utility pocket comprises a security mechanism for controlling access to contents of the utility pocket, wherein the security mechanism comprises at least one of a fingerprint scanner, a retina scanner, a pinpad, and a lock.

2. The system of claim 1, wherein the utility pocket is detachedly coupled to at least one of the front sleeve and the rear sleeve via a closure mechanism, wherein the closure mechanism comprises at least one of a zipper, a button, a fastener, a pin, a brad, a latch, and a hook-and-loop fastener.

3. The system of claim 1, wherein at least one of the front portion and the rear portion comprises a binder pocket, and wherein the utility pocket is substantially orthogonal to the binder pocket.

4. The system of claim 1, wherein the cover comprises at least one reinforcement tab manufactured from a rigid material that is coupled to at least one of the front sleeve and the second sleeve, and wherein the front sleeve and the second sleeve is manufactured from a stretchable material.

5. The system of claim 1, wherein the cover comprises at least one of a light, a speaker, a connectivity port, and a global positioning system (GPS) device.

6. The system of claim 1, wherein the cover comprises at least one of a texture and a graphic.

7. A cover removably coupled to a binder comprising a front portion and a rear portion and comprising: a front sleeve defining a cavity in which the front portion of the binder is received; a rear sleeve defining a cavity in which the rear portion of the binder is received; and a utility pocket coupled to at least one of the front sleeve and the rear sleeve, wherein the utility pocket comprises a security mechanism for controlling access to contents of the utility pocket, wherein the security mechanism comprises at least one of a fingerprint scanner, a retina scanner, a pinpad, and a lock.

8. The cover of claim 7, wherein the utility pocket is detachedly coupled to at least one of the front sleeve and the rear sleeve via a closure mechanism, wherein the closure mechanism comprises at least one of a zipper, a button, a fastener, a pin, a brad, a latch, and a hook-and-loop fastener.

9. The cover of claim 7, wherein at least one of the front portion and the rear portion comprises a binder pocket, and wherein the utility pocket is substantially orthogonal to the binder pocket.

10. The cover of claim 7, wherein the cover comprises at least one reinforcement tab manufactured from a rigid material that is coupled to at least one of the front sleeve and the second sleeve, and wherein the front sleeve and the second sleeve is manufactured from a stretchable material.

11. The cover of claim 7, wherein the cover comprises at least one of a light, a speaker, a connectivity port, and a global positioning system (GPS) device.

12. The cover of claim 7, wherein the cover comprises at least one of a texture and a graphic.

13. A method comprising: receiving, by a computing device processor and from a camera, a digital image of a binder; processing, by the computing device processor, the digital image to identify at least one dimension of the binder; generating, by the computing device processor, a three-dimensional model of the binder using the at least one dimension; generating, by the computing device processor, a three-dimensional model of a removable cover for the binder based on the three-dimensional model of the binder; and transmitting, by the computing device processor and to a printer, instructions to print the removable cover based on the three-dimensional model of the removable cover.

14. The method of claim 13, further comprising: determining, by the computing device processor, an optimal material type for the removable cover based on the identified at least one dimension of the binder.

15. The method of claim 14, wherein the printer is a three-dimensional (3D) printer, and wherein the instructions instruct the printer to 3D print the removable cover using the determined optimal material type.

16. The method of claim 14, wherein the printer is a screen printer, and wherein the instructions to print the removable cover comprise instructions to screen print a graphic on a portion of the optimal material type.

17. The method of claim 16, further comprising: receiving, by the computing device processor and from a user device, a user selection of the graphic.

18. The method of claim 13, wherein the binder comprises at least one of a three-ring binder, a notebook, a book, and a notepad.

* * * * *